US008220381B2

(12) United States Patent
Nickl

(10) Patent No.: US 8,220,381 B2
(45) Date of Patent: Jul. 17, 2012

(54) COMBINED PISTON-EXPANDER COMPRESSOR

(75) Inventor: Jörg Nickl, Malter (DE)

(73) Assignee: Technische Universität Dresden, Dresden (DE)

( * ) Notice: Subject to any disclaimer, the term of this patent is extended or adjusted under 35 U.S.C. 154(b) by 828 days.

(21) Appl. No.: 11/719,557

(22) PCT Filed: Oct. 29, 2005

(86) PCT No.: PCT/DE2005/001981

§ 371 (c)(1),
(2), (4) Date: Feb. 3, 2009

(87) PCT Pub. No.: WO2006/053517

PCT Pub. Date: May 26, 2006

(65) Prior Publication Data

US 2009/0126562 A1 May 21, 2009

(30) Foreign Application Priority Data

Nov. 18, 2004 (DE) ..... 10 2004 056 298

(51) Int. Cl.
*F25B 9/06* (2006.01)
*F01B 1/02* (2006.01)

(52) U.S. Cl. ..... 92/147; 92/163

(58) Field of Classification Search ..... 92/147, 92/146, 150, 151, 152, 163
See application file for complete search history.

(56) References Cited

U.S. PATENT DOCUMENTS 7,040,595 B2 * 5/2006 Hirota ..... 251/129.07

FOREIGN PATENT DOCUMENTS

DE 10242271 B3 * 1/2004
DE 10313850 A1 * 10/2004
EP 1382922 A2 * 1/2004

* cited by examiner

*Primary Examiner* — Thomas E Lazo
(74) *Attorney, Agent, or Firm* — Antonelli, Terry, Stout & Kraus, LLP.

(57) ABSTRACT

The invention concerns a combined piston-expander compressor comprising a plurality of pistons (3, 14) which are mechanically coupled together by a piston rod (4), as well as a main slide (6), an auxiliary slide (7) and a control valve (9) for control purposes, characterized in that the main slide (6) is formed from a plurality of slide elements that are not interconnected, two outer slide bodies (6*a*, 6*b*) being provided. Control pistons (6*c*) with control edges and simple slide elements (6*d*) are arranged in a row between the outer slide elements, in the form of a small piston (6*a*) and a large piston (6*b*), such that a differential pressure acting on the outer slide elements (6*a*, 6*b*) automatically and mechanically holds together the main slide (6).

8 Claims, 5 Drawing Sheets

COMBINED PISTON-EXPANDER COMPRESSOR

The invention relates to a combined piston expander-compressor having a plurality of pistons mechanically coupled by a piston rod. Such devices are employed for example in thermodynamic heat-pump processes for coupling the expansion and compression of refrigerants in a cycle.

Combined piston expander-compressors can be used to particular advantage with the refrigerant carbon dioxide. Refrigerating systems or heat pumps having carbon dioxide as refrigerant are preferably fashioned with a plurality of work-performing expansion steps whose energy is utilized to compress the carbon dioxide to a higher pressure.

In the prior art, DE 102 42 271 B3 discloses a piston expansion machine according to the free-piston principle for a thermodynamic heat-pump process having work-performing expansion of the refrigerant. The energy for compressing the refrigerant to the high-pressure stage is generated by the work-performing expansions of a plurality of expanders. The pistons of the piston expansion machine and of the high-pressure compressor are mechanically coupled with a common piston rod.

The compression stage is fashioned in two stages, the compressor of the low-pressure stage compressing the refrigerant to intermediate pressure and the subsequent compression to high pressure being effected by the work-performing expansion by the coupled piston expansion machine.

In terms of design and manufacturing, combined piston expander-compressors having multistage expansion are very complicated devices. In particular, the known devices have the disadvantage that, given a plurality of pistons disposed on one piston rod and the associated main and auxiliary slides required for control, the manufacturing tolerances must be very close in order to enable the proper functioning of the devices. The stringent requirements on manufacturing quality lead to extraordinarily high costs and also to components that are very difficult to handle and necessitate long assembly times and finish operations in practical assembly.

It is an object of the invention so to improve the design of a combined piston expander-compressor that the manufacturing and assembly costs can be reduced through a simple and robust design. It is further a goal of the invention that a variety of processes can be implemented with the device according to the invention.

According to the invention, the object is achieved with a combined piston expander-compressor having a plurality of pistons mechanically coupled by a piston rod and having a main slide, an auxiliary slide and a control valve, in that the main slide is constructed from a plurality of non-interconnected slide bodies. There are two outer slide bodies, which are fashioned as a small piston and as a large piston, control pistons having control edges and simple slide bodies being disposed between these outer slide bodies. According to the invention, a pressure difference acting on the outer slide bodies has the result that the main slide automatically holds together mechanically without the need for mechanical connections between the individual slide bodies.

Further according to the invention, there is on the piston rod a driver plate, which is fashioned engagingly into the auxiliary slide so as to move the latter in dependence on the dead-center positions of the piston rod. Here the driver plate is preferably fashioned as a circular concentric plate of spring steel. There is furthermore a control valve between the auxiliary slide and the main slide. An especially preferable design can be achieved in that there are cylinder cover and cylinder housing in alternation as well as, terminatingly, a driver housing, which are held together by tension rods. Between the adjacent components there are seals, in particular metal seals. The double-acting pistons of the expander, the high-pressure compressor piston and the piston-rod sleeves disposed between the pistons as well as the driver plate are interconnected by a central bolt. There are preferably piston rings as seal elements on the pistons and on the piston-rod sleeves. The connection between the main slide and the expansion cylinders is fashioned as overflow ducts in the form of bores. The connection between the main slide and the connectors is fashioned as milled ducts in cylinder covers and cylinder housings respectively.

The concept of the invention consists in that, because the main slide is constructed from a plurality of non-interconnected slide bodies, there comes about a device element that can be manufactured in particularly efficient fashion from individual parts and that can be emplaced in the device piece by piece in assembly without additional mechanical interconnections, so that no costly centering and positioning operations are necessary for assembling the main slide. In this way marked savings in costs and time are effected from a manufacturing standpoint.

According to the invention, the expander with multistage expansion essentially comprises a plurality of double-acting pistons equal in number to the number of stages, which pistons are disposed in the associated cylinders. The work of expansion of the expander is transmitted to the also double-acting pistons of the high-pressure compressor via the common piston rod. The use of a common piston rod requires that appropriate shoulders on the cylinder covers make all the cylinders align so that there is no need to allow for excessively great plays. Small plays are fundamentally important for the internal tightness of the machine.

What is more, in contrast to the separate control block employed in steam locomotives, made up of main slide with housing having relatively long free overflow lines to the cylinder working spaces, a compact construction is realized with parallel disposition of the working and slide piston axes, which offers large cross-sectional areas with favorable flow conditions by virtue of the very short overflow lines and small dead volume.

The basic idea of the invention is that a multipart main slide is employed, which, however, must always be held together by corresponding pressure forces of the two outer slide bodies. The main slide preferably comprises three distinct types of slide bodies, of which only the double slide pistons, the control pistons, possess a control function. The outer pistons, the small piston and the large piston, have unequal diameters for reversing the force direction upon reversal of control. Here high pressure is always applied to the smaller piston while high pressure and evaporator pressure are applied in alternation to the large one.

This is effected with the auxiliary slide, which is moved by a driver plate shortly before the piston rod attains its dead-center positions. Said driver plate is fashioned as a circular concentric plate of spring steel and rigidly connected to the piston rod. By virtue of radial play of the driver plate relative to the rod connecting the two shoulders of the auxiliary slide, it is guaranteed that the driver plate moves the auxiliary slide only when the shoulders are reached shortly before the dead-center position in question.

Between the auxiliary slide and the main slide there is further an adjustable throttle valve, the control valve, with which the dwell time in the dead-center positions can be altered via the control reversal time. In this way the frequency of the expander and thus the throughput can be controlled, so that for example the superheating at the evaporator can be regulated.

The inner main slide bodies have so-called control edges and, in the dead-center positions, regulate the pressure applied to the working pistons in accordance with the direction of motion. In this way a multistage full-pressure principle is implemented, which principle is characterized by filling and sliding out over the complete stroke and is in no way inferior in effectiveness to single-stage expansion control with partial filling. The decisive advantage lies in simple control and better force variation with direct coupling of expander and compressor.

Further details, features and advantages of the invention can be inferred from the description of exemplary embodiments below, with reference to the associated Drawings, in which.

Figure 3:
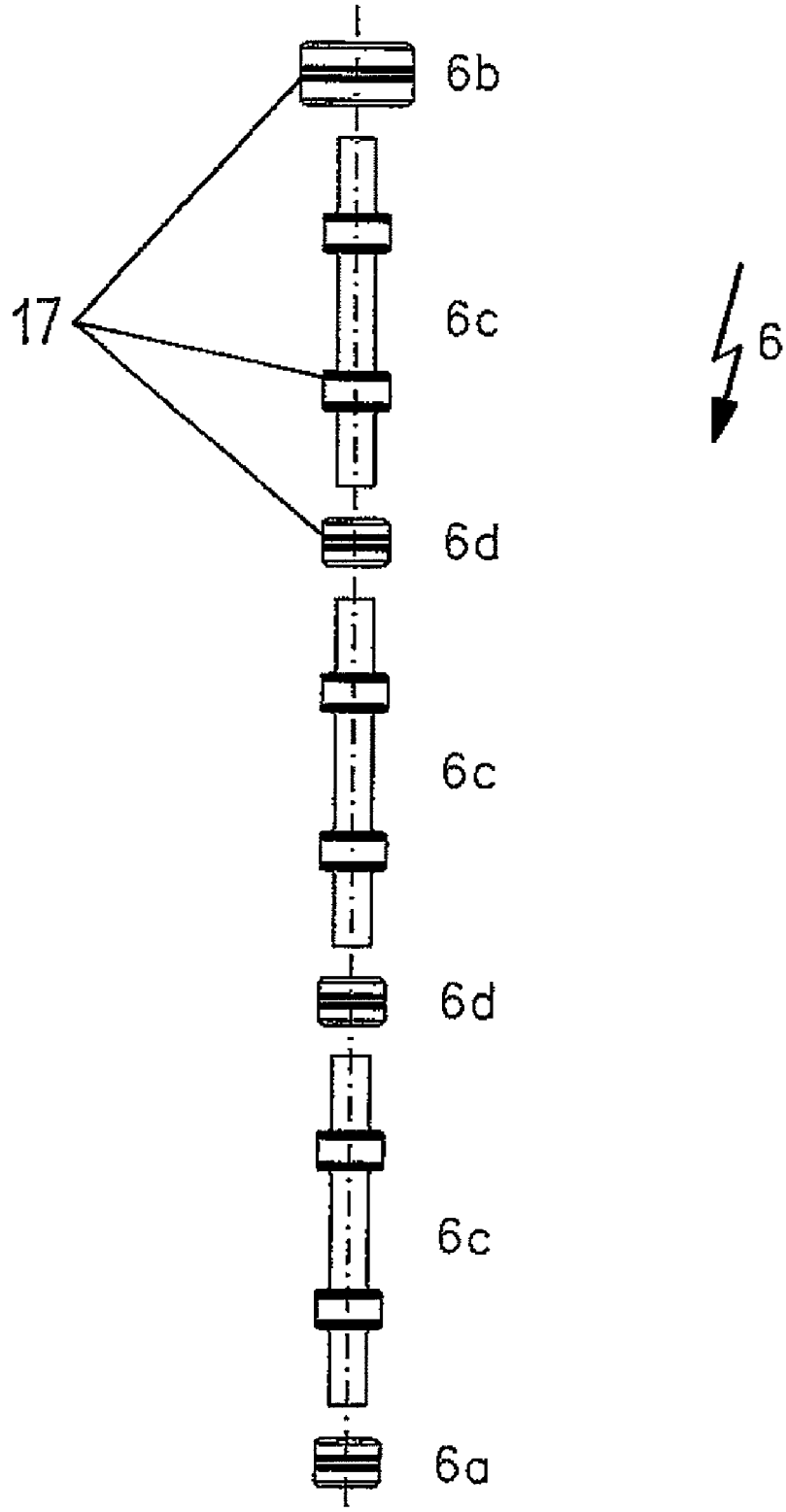

FIG. 3 is an exploded view of main slide 6 with its constituents, small piston 6*a*, large piston 6*b* and control pistons 6*c* as well as the simple slide bodies 6*d;*

Figure 1:
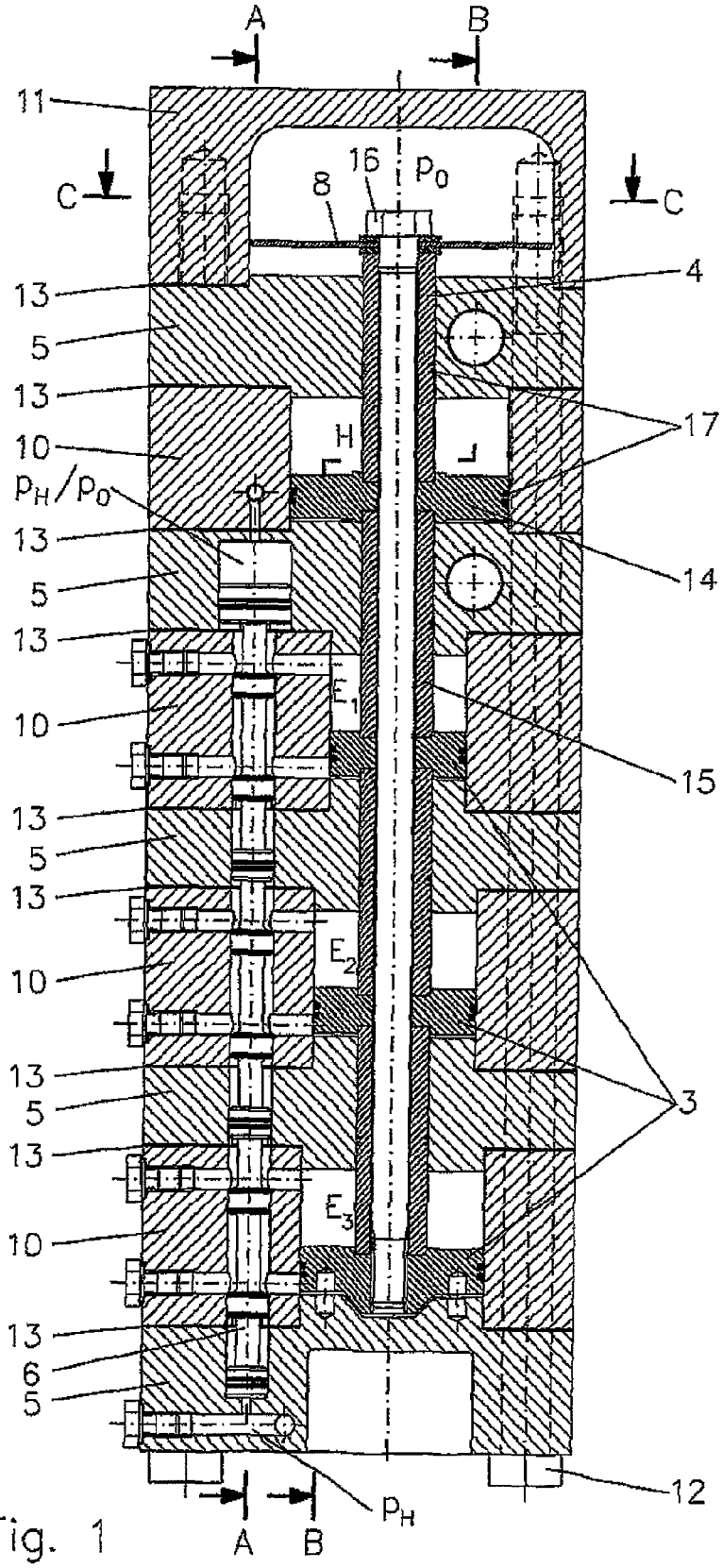
FIG. 1 depicts in cross section a combined piston expander-compressor.
Figure 4:
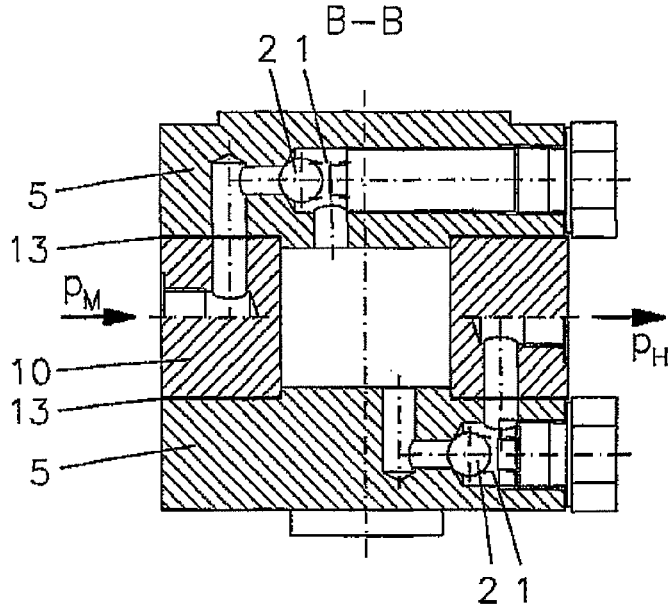
Figure 5:
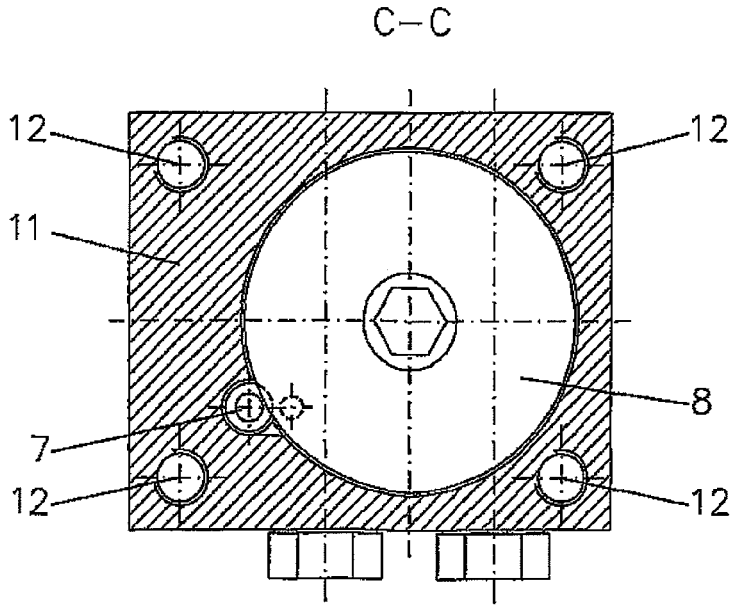
Figure 6A:
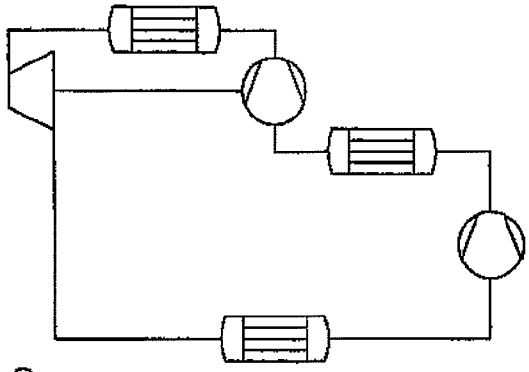
Figure 6B:
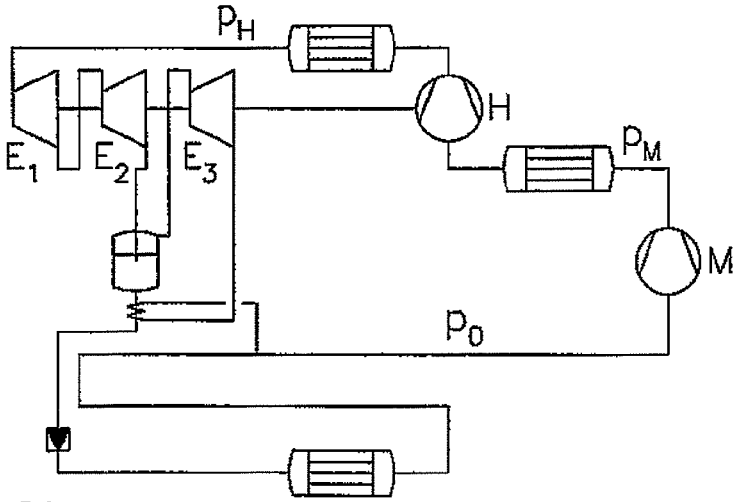
Figure 6C:
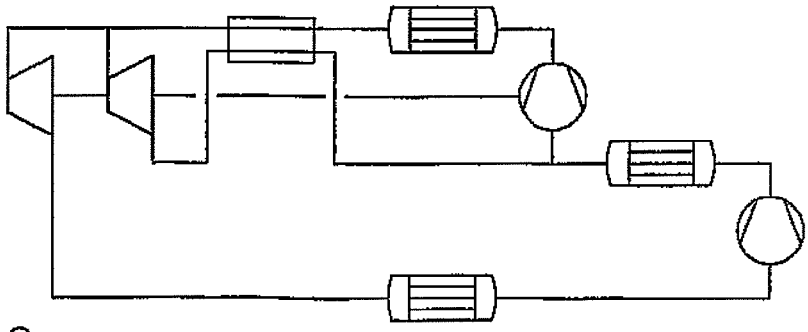

FIG. 4 depicts a cylinder housing in cross section on section line B-B of FIG. 1;

FIG. 5 depicts a cross section of the driver housing on section line C-C of FIG. 1;

FIG. 6*a* is a flow sheet of the cycle with single-stage expansion;

FIG. 6*b* depicts a preferred cycle for the application of the combined piston expander-compressor; and FIG. 6*c* depicts a cycle in which parallel expansion is performed.

FIG. 1 depicts in cross section a combined piston expander-compressor according to the invention. The combined piston expander-compressor essentially comprises a plurality of cylinder covers 5, cylinder housings 10 and driver housing 11. The cylinders of the expansion stages are lined up according to the temperature gradient. The components are held together by tension rods 12. Between the housing parts there are thin, soft metal seals 13. The pistons of expander stages 3 and high-pressure compressor 14, driver plate 8 and piston-rod sleeves 15 are held together by a central bolt 16. All working and slide pistons 3, 14, 6*a*, 6*b*, 6*c*, 6*d* and piston-rod sleeves 15 have piston rings 17 as seal elements. Because of the length of the bore, piston rings 17 are also employed as seal elements on piston-rod sleeves 15.

In the housing parts there are furthermore numerous bores, which for example port driver housing 11 to evaporator pressure $p_0$ and port small piston 6*a* on main slide 6 to high pressure $p_H$. The pressure ports on auxiliary slide 7 are implemented in similar fashion.

While the overflow ducts through cylinder housing 10 between main slide 6 and the expansion cylinders are fashioned as bores, milled ducts in cylinder covers and cylinder housings 5, 10 serve as connection to connector 18.

Optionally, ports for refrigerant lines are provided in cylinder housings 10, enabling a universal employment of the device for various configurations within implementable processes.

High-pressure compressor piston 14 compresses refrigerant from intermediate pressure to high pressure, the mechanical energy for the compression operation being furnished by the expansion of the refrigerant via double-acting pistons 3 in the individual working compartments $E_1$, $E_2$ and $E_3$.

Figure 2:
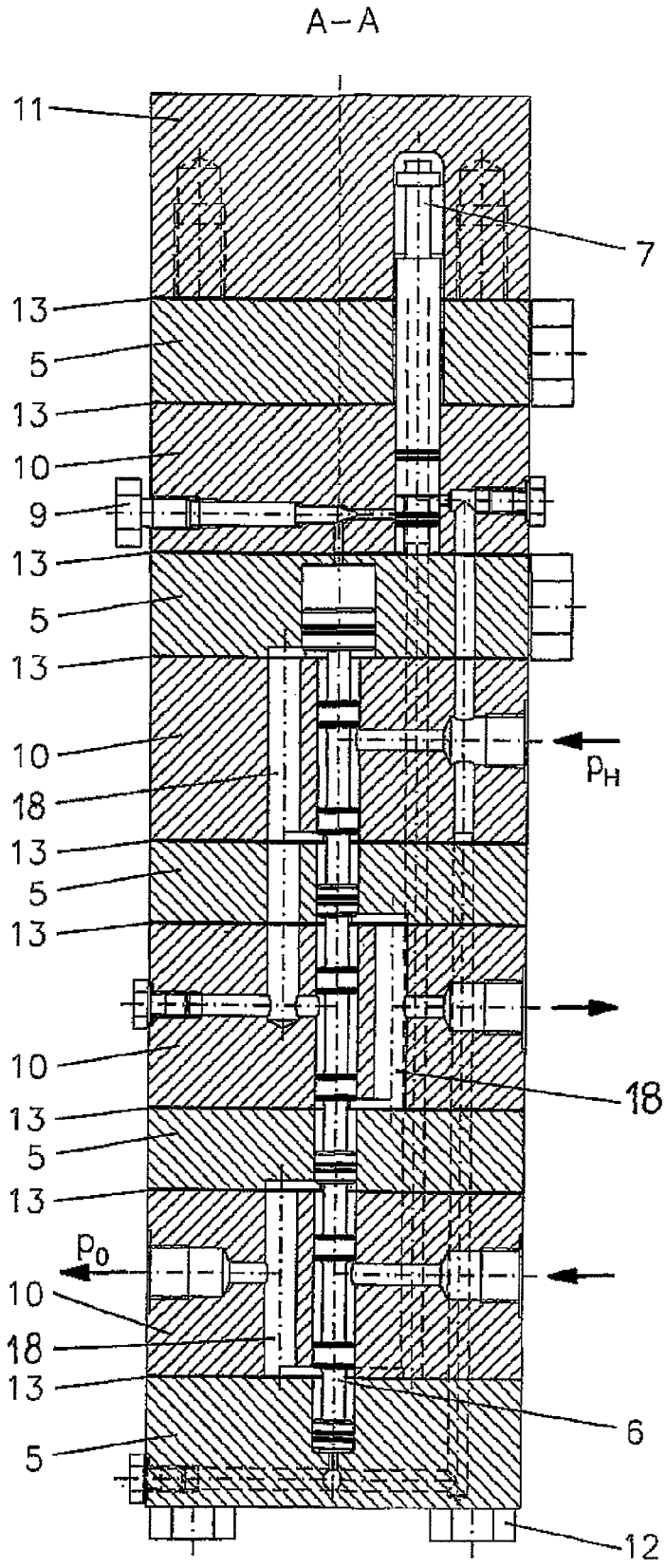
FIG. 2 depicts the device according to the invention in cross section on section line A-A of FIG. 1.

FIG. 2 depicts the device according to the invention in cross section on section line A-A of FIG. 1. Main slide 6 is shown in connection with auxiliary slide 7 and control valve 9. The refrigerant flow directions at the inlets and outlets are characterized by arrows by way of example.

FIG. 3 depicts in exploded view main slide 6 with its components, small piston 6*a*, large piston 6*b* and control pistons 6*c* as well as simple slide bodies 6*d*.

According to the concept of the invention, the slide bodies are not mechanically interconnected. The slide bodies are held together via a pressure difference between the refrigerant acting on small piston 6*a* and on large piston 6*b*.

According to the invention, high pressure is always applied to small piston 6*a*, while evaporation pressure or high pressure is applied in alternation to large piston 6*b*.

Control pistons 6*c* are double-acting and have control edges. They are sealed with piston rings 17 in exactly the same way as simple slide bodies 6*d*. There are to be a number of control pistons 6*c* equal to the number of expansion stages, with simple slide bodies 6*d* disposed between every two such control pistons. At the outer ends the control pistons are, or the main slide is, bounded by small piston 6*a* and large piston 6*b* respectively. This embodiment is particularly advantageous because the individual control pistons 6*c* are fashioned identically as to design and also the simple slide bodies 6*d* are each identical in construction, which reduces the manufacturing costs for the device in accordance with the object of the invention.

In a particularly preferred embodiment of the invention, small piston 6*a* and simple slide bodies 6*d* are fashioned identically as to design, which further reduces the costs for the device.

FIG. 4 depicts the cylinder housing of the high-pressure compressor in cross section on section line B-B of FIG. 1. Springs 1 and automatic ball valves 2 can be identified in this view.

FIG. 5 is a cross section of driver housing 11 on section line C-C of FIG. 1. Driver plate 8 and auxiliary slide 7 can be seen in the top view. Also illustrated are tension rods 12, which extend from driver housing 11 through the entire housing of the piston expander-compressor.

FIG. 6*a* depicts a flow sheet of a cycle that can in principle be implemented with the device according to the invention.

FIG. 6*b* depicts a preferred application of the combined piston expander-compressor illustrated in FIG. 1 to FIG. 5 of the Drawings, there being three expansion stages with liquid separation between the second and third expansion stages.

In practice, evaporators are most often very far away from the other components of refrigeration plants, so that it is necessary to transport refrigerants to the evaporators at near-ambient temperature with little heat inflow. Only the liquid from the separator between the second and third expansion stages is conveyed to the throttle valves of the evaporators, because this liquid can absorb the majority of the heat of evaporation. The vapor fraction furthermore has the major portion of the capacity to perform work and is expanded in the subsequent stage, performing work, and subsequently cools the liquid stream from the separator.

In order to implement the processes of FIG. 6*a* and FIG. 6*b*, the connector between the second ($E_2$) and third ($E_3$) expansion stages is subdivided and the ports are led to the outside. In the case of the fashioning of FIG. 6*a*, a pipe connection is installed; in that of FIG. 6*b*, the separator is connected in corresponding fashion.

Finally, FIG. 6*c* depicts a process in which a parallel expansion is performed, leading to an increase in coefficient of performance. For this process, again, the combined piston expander-compressor can be used with advantage, because the necessary working compartments are in principle present in the illustrated embodiment of the invention.

The mode of action of the combined piston expander-compressor according to the invention can be sketched as follows:

After low-pressure compressor M in FIG. 6*b* has been started, gas initially flows into the cylinders of high-pressure compressor H, because the latter is equipped with automatic spring-loaded ball valves 1, 2, which open when there is a pressure drop in the desired direction of flow. Because in this case the expander is not yet functioning, the pressure valves of the high-pressure compressor also initially let the gas through, so that after a short time the pressure difference across the expander builds up, the expander starting up and compression commencing. The desired pressures come into being later in accordance with the thermodynamic configuration.

LIST OF REFERENCE CHARACTERS

1 Springs
2 Automatic ball valves
3 Double-acting pistons of expander
4 Common piston rod
5 Cylinder cover
6 Main slide
6*a* Small piston
6*b* Large piston
6*c* Control piston
6*d* Simple slide body
7 Auxiliary slide
8 Driver plate
9 Control valve for operating frequency
10 Cylinder housing
11 Driver housing
12 Tension rod
13 Metal seals
14 High-pressure compressor piston
15 Piston-rod sleeves
16 Central bolt
17 Piston rings
18 Connector
$E_1$ Working compartments
$E_2$ Working compartments
$E_3$ Working compartments
M Low-pressure compressor
H High-pressure compressor

The invention claimed is:

1. A combined piston expander-compressor having a plurality of pistons mechanically coupled by a piston rod as well as a main slide, an auxiliary slide and a control valve for control, wherein the main slide is constructed from a plurality of non-interconnected slide bodies, there being two outer slide bodies that are fashioned as a small piston and as a large piston, and wherein control pistons having control edges and simple slide bodies are so disposed in alignment between the outer slide bodies that a pressure difference acting on the outer slide bodies automatically holds the main slide together mechanically.

2. The piston expander-compressor of claim 1 wherein on the piston rod there is a driver plate that is so fashioned as to engage in and move the auxiliary slide before the dead-center positions of the piston rod.

3. The piston expander-compressor of claim 2 wherein the driver plate is fashioned as a circular concentric plate of spring steel.

4. The piston expander-compressor of claim 1 wherein there is a control valve between the auxiliary slide and the main slide.

5. The piston expander-compressor of claim 1 wherein there are cylinder covers and cylinder housing in alternation as well as, terminatingly, a driver housing, which are held together by tension rods.

6. The piston expander-compressor of claim 5 wherein there are metal seals between adjacent components.

7. The piston expander-compressor of claim 1 wherein the double-acting pistons of the expander, the high-pressure compressor piston, the piston-rod sleeves disposed between the pistons and the driver plate are interconnected by a central bolt.

8. The piston expander-compressor of claim 1 wherein there are piston rings as seal elements on the piston-rod sleeves.

* * * * *